US005270619A

United States Patent [19]

Iannini

[11] Patent Number: 5,270,619

[45] Date of Patent: Dec. 14, 1993

[54] NOVELTY INERT GAS DEVICE HAVING SEPARABLE COMPONENTS

[76] Inventor: Robert E. Iannini, Brook Rd., Mont Vernon, N.H. 03057

[21] Appl. No.: 779,944

[22] Filed: Oct. 21, 1991

[51] Int. Cl.[5] ..... H05B 41/16

[52] U.S. Cl. ..... 315/248; 315/34; 40/545

[58] Field of Search ..... 40/541, 545, 550; 315/248, 34

[56] References Cited

U.S. PATENT DOCUMENTS

| | | | |
|---|---|---|---|
| 2,181,889 | 12/1939 | Hanson | 315/248 |
| 2,184,530 | 12/1939 | Penney et al. | 40/545 |
| 2,322,008 | 6/1943 | Fodor | 315/248 |
| 3,411,003 | 11/1968 | Pearce | 40/545 |

*Primary Examiner*—Robert J. Pascal
*Assistant Examiner*—Michael B. Shingleton
*Attorney, Agent, or Firm*—Davis, Bujold & Streck

[57] ABSTRACT

A novelty device comprising an energizing circuit, including an dielectric base material, having a circuit and a conductive member attached to a first surface of the dielectric base material. The novelty device further includes a transparent display, containing an inert gas, such as neon or argon, being illuminated when the transparent display is brought into sufficiently close proximity to the surface opposite the surface carrying the conductive member and the energizing circuit, when power is supplied to the circuit. The invention also relates to a method for illuminating the transparent display, containing an inert gas, such as neon or argon, by the use of the energizing circuit.

20 Claims, 2 Drawing Sheets

NOVELTY INERT GAS DEVICE HAVING SEPARABLE COMPONENTS

The present invention relates to a novelty device which includes a removable transparent display containing an inert gas and a energizing base component for energizing the removable transparent display once it is brought into sufficiently close proximity to an energizing surface of the base component.

BACKGROUND OF THE INVENTION

There are a variety of known novelty devices in which a transparent member, containing an inert gas, is energized by an energizing mechanism. However, in these known devices, the transparent member is fixedly connected to the energizing member and such connection does not facilitate easy interchangeability of a base member with a variety of different transparent members.

Wherefore, it is an object of the invention to provide a novelty device in which the energizing component is completely separate and independent of the removable transparent display containing the inert gas so that a variety of different removable transparent displays may be readily interchanged with the energizing component.

A further object of the invention is to provide an insulating member between an energizing surface of the energizing component and the removable transparent display to prevent the user of the novelty device from becoming electrocuted or injured by the energizing surface.

A still further object of the invention is to provide a novelty device which is relatively easy to manufacture and completely safe to operate.

Another object of the invention is provide a novelty device in which a variety of different removable transparent displays can be energized singularly or together by a single energizing device.

Still another object of the invention is to provide a transparent display which can be shaped as a figurine, a stirring rod, the hands of a clock or any other desired shape suitable for containing an inert gas.

These and other objects of the invention will be better understood by having reference to the accompanying drawings and the following description.

SUMMARY OF THE INVENTION

The present invention provides a novelty device, for energizing a transparent display containing an inert gas, comprising a base member formed of a dielectric material defining first and second opposed surfaces, energizing means including an electrically conductive substance disposed on the first surface of said base member, said energizing means being connectable to a power source and, when powered, producing a sufficient charge in said substance to produce sufficient electromagnetic energy to ionize an inert gas in a transparent display when said transparent display is brought into sufficiently close proximity to said second surface without a physical connection between said transparent display and said energizing means.

The present invention also provides a method of energizing a novelty device comprising the steps of providing a base member formed of an dielectric material having first and second opposed surfaces with an electrically conductive substance supported on the first surface of said base member, charging the conductive substance with energizing means to produce an alternating electromagnetic field sufficiently to ionize an inert gas in a transparent display which is completely physically independent of and removable from means for producing the charge and said base member.

BRIEF DESCRIPTION OF THE DRAWINGS

Preferred embodiments of the present invention will now be described, by way of example, with reference to the accompanying drawings, in which.

DESCRIPTION OF THE PREFERRED EMBODIMENT

Figure 1:
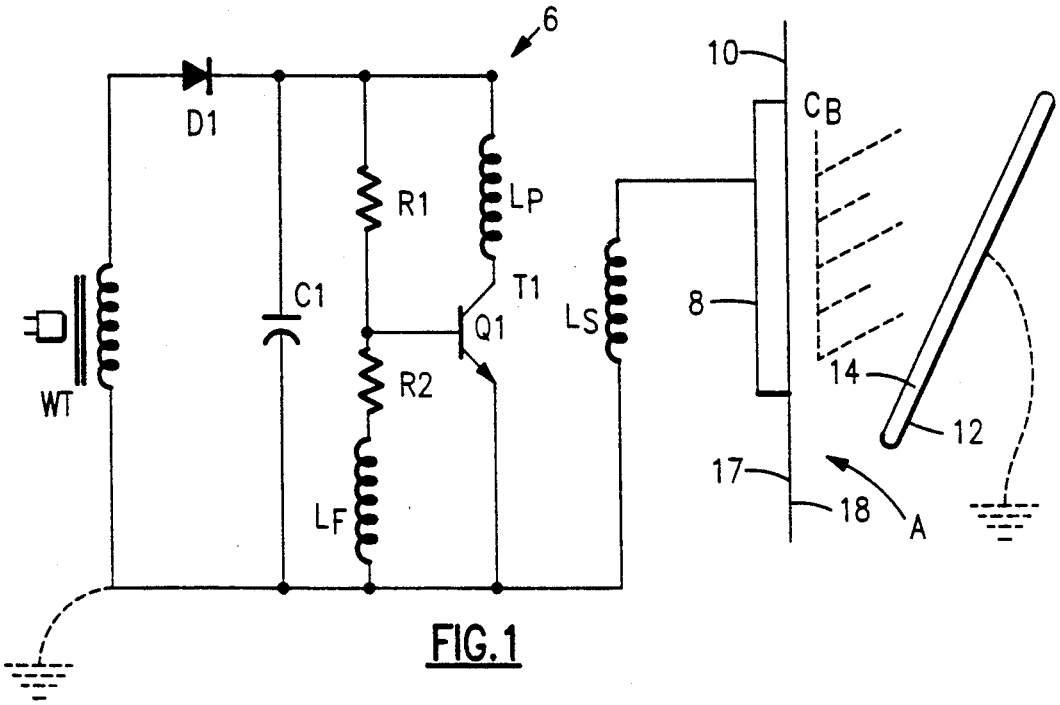
FIG. 1 is a diagrammatic representation of circuit for the energizing component of the present invention.
Figure 2:
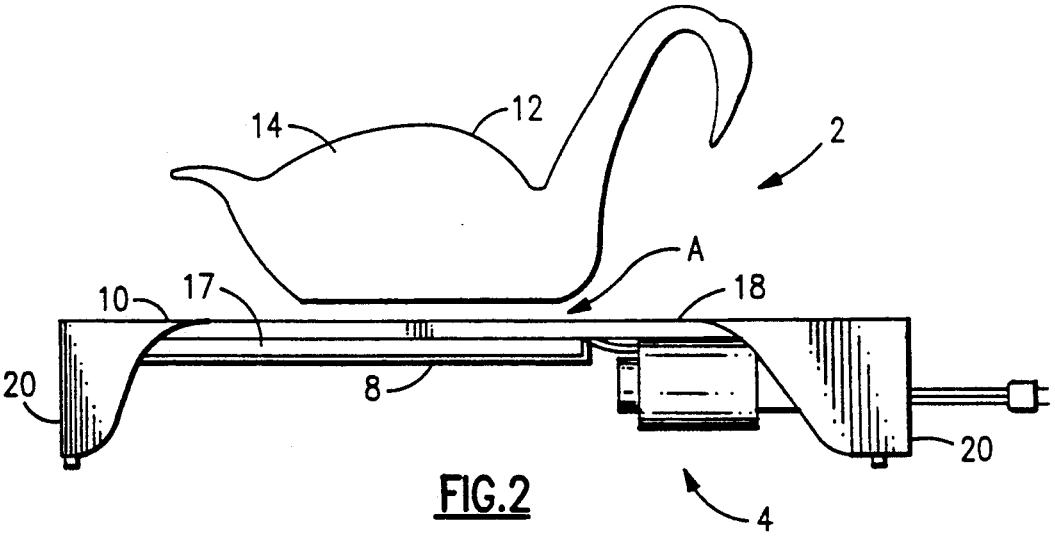
FIG. 2 is a diagrammatic representation showing a use of the novelty device according to the present invention.
Figure 3:
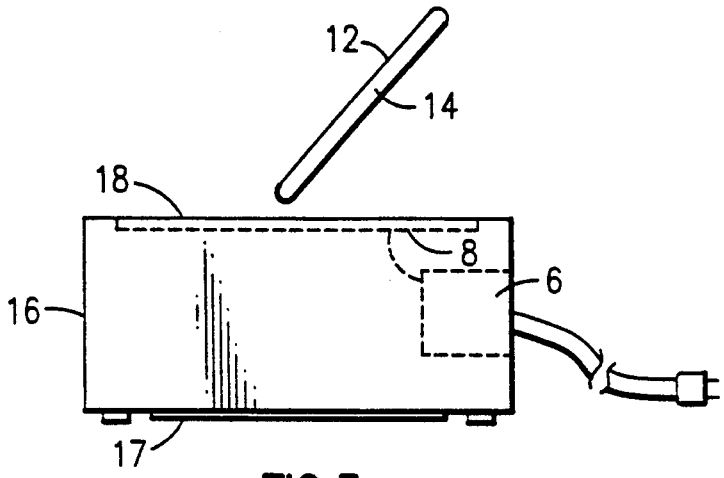
FIG. 3 is a diagrammatic representation showing a further embodiment of the novelty device according to the present invention.

Turning now to FIGS. 1 through 3, a detailed description of the preferred embodiments of the invention will now be provided. The novelty device 2 comprises an energizing component 4 containing an energizing circuit 6. The circuit 6 generates an output voltage which is supplied to a metallic surface or plate 8 secured, adhesively or otherwise, to a first surface 17 of an insulated barrier or member 10. The novelty device 2 further comprises a transparent container 12 made, for example, of glass or plastic and containing an inert (noble) ionizable gas 14 such as neon, argon or krypton. When the plate 8 is sufficiently charged by the energizing circuit 6 and the removable transparent display 12 is brought into sufficiently close proximity to a second, opposed, surface 18 of the insulated barrier or member 10 supporting the surface or plate 8, the inert gas 14 contained within the removable transparent display 12 is ionized thereby illuminating the removable transparent display 12. Depending on the field created by the charged plate 8, when the removable transparent display 12 is moved a sufficient distance away from the second surface 18 of the insulated member 10 carrying the plate 8, e.g. about 4 to 10 inches, ionization of the inert gas 14 contained within the removable transparent display 12 ceases and the illumination effect of the inert gas 14 will no longer be present. The transparent display 12 is not physically connected to the energizing component 4 and is completely independent of and removable from the energizing component 4.

The insulated member 10 is a non-metallic member which has good electrical dielectric properties and can, for example, be one of the following materials, polypropylene, polyester or a phenolic resin. The shape of the insulating member 10 can vary and may comprise a flat surface supported on a plurality of legs 20 (two legs for instance as can be seen in FIG. 2) or may comprise a box-like container 16 completely enclosing the energizing circuit 6 to define a completely enclosed housing (as can be seen in FIG. 3). The box-like container 16 ensures that all of the components of the energizing circuit 6 are not readily accessible to a user and thereby further assists in preventing accidental electrocution or shock of a user. The box like container 16 can be provided with a removable cover 17 to provide access to the components of the energizing circuit 6.

Operation of the present invention is similar to that of a capacitor when used in an AC circuit. The metallic plate 8 is one of the plates and the insulating member 10 is the dielectric of the capacitor. The virtual second plate of the capacitor is the air A located adjacent the second surface 18 of the insulating material 10 opposite the plate 8. When a removable transparent display 12 is brought within sufficiently close proximity to the second surface 18 of the insulating material 10, the removable transparent display 12 becomes a part of the virtual second plate of the capacitor and high frequency energy then flows through the air A to the removable transparent display 12 and causes ionization of the inert gas 14 thereby illuminating that component. This effect is made possible by the mechanical design and the high frequency current generated by the circuit of the present invention. The present inventor has discovered that the inert gas 14 contained within the removable transparent display 12 initially has a very small capacitance until the gas is ionized.

An important feature of the insulating material 10 is that it functions as a barrier between the plate 8 and the transparent display 12 and prevents any arcing of the energy that may otherwise occur between the plate 8 and the display 12 if the insulating member 10 was not located therebetween.

The circuit of the present invention will now be described in detail with reference to FIG. 1. The circuit provides a low energy electromagnetic field and the user is not exposed to a dangerous voltage or current. The energizing component is powered via a transformer WT connected to a 120 VAC electrical supply, such as a wall outlet. Alternatively, a 12 volt DC battery could be used to power the circuit 6, but this arrangement causes the device to run hotter and produce a less intense ionization of the inert gas. The circuit 6 is designed to generate high frequency energy at a potential of approximately a 1,000 volts so that it is effective in ionizing the inert gas through the reactant of the virtual base capacitance CB. A second transformer T1 has a secondary winding Ls, having a large number of turns (approximately 1300 turns), which is coupled to a primary winding Lp (having approximately 10 turns) and an associated feed back winding Lf (having approximately 10 turns). An oscillator Q1 is initially biased into a conductive state via a resistor R1 (10 k). A collector current now starts to flow through the driving winding Lp inducing a forward bias on oscillator Q1 through the feedback winding Lf. This base current is controlled by a limiting resistor R2 (1 k) and continues to flow until the collector current ceases to change and can no longer support this state. The collector current then reverses and the sequence repeats.

Figure 4:
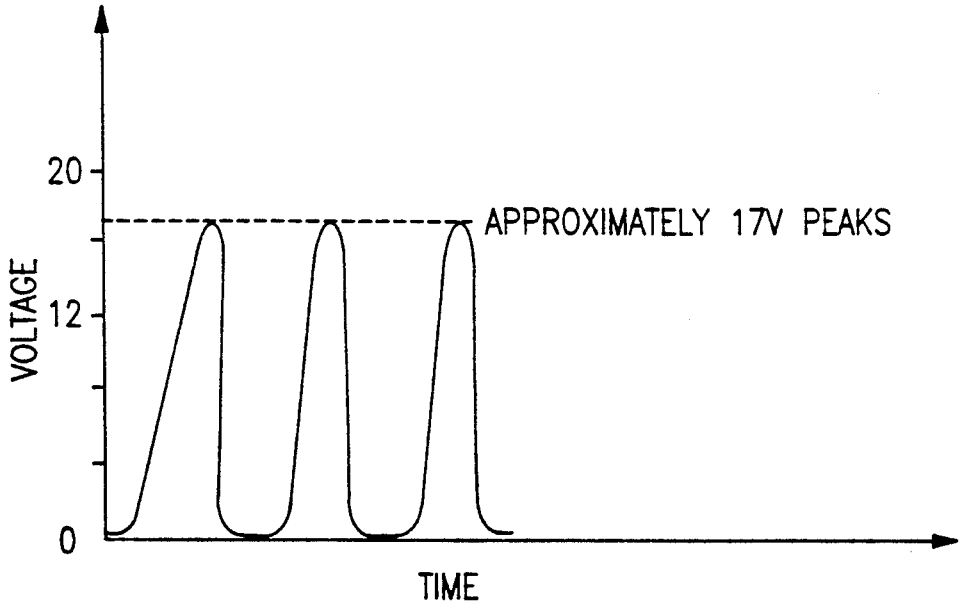
FIG. 4 is a diagrammatic representation of a voltage versus time graph for the plate of the energizing component.

A periodic wave form (see FIG. 4) then induces a high voltage in the output winding Ls, depending upon the turn ratio. This energy is now directly connected to the metallic plate 8 supported on the first (underside) surface of the insulting member 10 and constitutes the base capacitor CB.

This system provides high peak but a low average power wave and consequently can operate in an unloaded state when a transparent display 12 containing an ionizable gas is not located adjacent the second surface 18 of the insulating material 10.

It is important for the circuit to be able to operate efficiently within the above parameters while, at the same time, still obtaining an initial high voltage so that energization of the transparent display can be consistently obtained. This approach now provides an enhanced ignition state by utilizing the positive sinusoidal peaks of the 12 VAC generated by the transformer WT usually about 1.4 times that value, i.e. about 17 VAC. Removal of the display results in use of far less RMS power as current is only used on the positive peaks. This current also provides visual strobing effect above the annoying flickering rate (usually around 15 pulses per second) which can be detected by the human eye. A unique visual effect, i.e. producing an optical illusion, can be produced when the transparent display is in motion, for example, rotating a piece of tubing.

This enhanced ignition state is obtained by providing a modulated wave produced by the rectifying action of diode D1 (IN4001). The modulated envelope of these pulses contain the high frequency energy to consistently ignite the gas in the display. It is important to note that the selection of capacitor C1 (a 10 mfd, 16 V capacitor, for example) determines the energy in these pulses and provides a ratio of peak to average power that is optimized for the system.

The use of a modulated wave of high frequency energy pulses above the flicker rate of the human eye. This wave provides high peak energy for enhancement of ignition but low average or RMS power.

The use of the modulated pulse rate to provide an animated effect when the display tube is rotated, gyrated or put into other states of periodic motion.

Grounding of the device (2) is accomplished by the high frequency energy, generated by the electronics (4) in the base, being ground returned via the intrinsic capacitance of the transformer WT. This now completes the loop so that energy can flow from the metallic plate (8) to the display (12) to virtual ground via the capacitance of the surroundings and back to the base via the transformer WT.

It is to be appreciated that the shape of the insulating member 10 can be of any desired configuration, i.e. rectangular, square, circular, as long as it provides an insulating barrier between the plate 8 and the transparent display 12.

The teaching of the present invention is also applicable to a clock in which the hands of the clock may comprises two separate transparent displays, each containing an inert gas, with the energizing component of the present invention located behind the face of the clock, with the plate 8 comprising a metallic peripheral ring, attached to a rear surface of the clock face, for energizing the hands of the clock as they rotate about the clock face.

Since certain changes may be made in the above novelty device without departing from the spirit and scope of the invention herein involved, it is intended that all of the subject matter contained in the above description and/or shown in the accompanying drawings shall be interpreted as being illustrative of the inventive concept herein involved and shall not be construed as limiting the invention.

I claim:

1. A novelty device, for energizing a transparent display containing inert gas, comprising:

a base member formed of a dielectric material defining a first and second opposed surfaces;

energizing means including an electrically conductive substance disposed on the first surface of said base member, said energizing means being connectable to a power source and, when powered, producing a sufficient charge in said substance to produce electric magnetic energy to ionize an inert gas in a transparent display when said transparent display is brought into sufficiently close proximity to said second surface without a physical connection between said transparent display and said energizing means; said energizing means comprises an electrical circuit for generating, when powered by said power source, a high voltage alternating current, the generated alternating current being modifying by the electrical circuit to produce periodic positive peak current and the electrical circuit supplying only the periodic positive peak current to said conductive substance.

2. A novelty device according to claim 1, wherein said conductive substance is a metallic plate and said circuit generates a voltage of approximately 1000 volts on said metallic plate.

3. A novelty device according to claim 2, wherein said device further includes a transparent display containing an inert gas, and said transparent display is physically independent of and removable from said base member, said metallic plate and said electrical circuit.

4. A novelty device according to claim 3, wherein inert gas is one of argon, neon and krypton.

5. A novelty device according to claim 4, wherein said transparent display is shaped as a stirring rod.

6. A novelty device according to claim 4, wherein said transparent display is shaped as a figurine.

7. A novelty device according to claim 1, wherein said base member is mounted on legs for supporting said base member on a desired surface.

8. A novelty device according to claim 1, wherein said base member comprises a container substantially enclosing the energizing means to prevent a user of the novelty device from touching the energizing means.

9. A novelty device according to claim 1, wherein said conductive substance is an electrically conductive member affixed to the first surface of said base member.

10. A novelty device according to claim 9, wherein said electrically conductive member is a metallic plate.

11. A novelty device according to claim 1, wherein said dielectric material is a plastic material.

12. A novelty device according to claim 1, wherein said dielectric material is a material selected from the group consisting of polypropylene, polyester, and phenolic resin.

13. A novelty device for energizing a transparent display containing an inert gas, said novelty device comprising:

a base member formed of a dielectric material defining first and second opposed surface;

an energizing circuit, including a conductive laminate, attached to the first surface, said energizing circuit being connectable to a power source and, when powered, producing sufficient energy at a frequency greater than the flicker rate of the human eye for ionizing an inlet gas in a transparent display; said energizing circuit comprises an electrical circuit for generating, when powered by a said power source, a high voltage alternating current, the generated alternating current being modifying by the electrical circuit to produce periodic positive peak current and the electrical circuit supplying only the periodic positive peak current to said conductive laminate; and a transparent display, containing an inert gas, which is completely physically independent of and removable from both said energizing circuit and said base member, and when said energizing means sufficiently charges the conductive laminate and said transparent display is brought into sufficiently close proximity to the second surface, said inert gas in said transparent display is ionized.

14. A method of energizing a novelty device comprising the steps of:

providing a base member formed of a dielectric material having first and second opposing surfaces with an electrical conductive substance supported on the first surface of said base member;

charging the conductive substance with energizing means to generate a high voltage alternating current, modifying the generated alternating current to produce periodic positive peak current, and supplying only the periodic positive peak current to energizing said conductive substance, the periodic positive peak current producing an electromagnetic field sufficient to ionize an inert gas in a transparent display which is completely physically independent of and removable from both the means for producing the charge and said base member.

15. A method according to claim 14, comprising the steps of:

providing a transparent display containing an inert gas; and bringing the transparent display into sufficient close proximity to the second surface to cause ionization of the inert gas contained within the transparent display.

16. A method according to claim 15, further comprising the step of moving the transparent display a sufficient distance away from the second surface of the insulating barrier, when desired, to stop ionization of the inert gas contained within the transparent display.

17. A method according to claim 16 further comprising the step of:

producing the periodic positive peak current at a frequency greater than the flicker rate of the human eye.

18. A novelty device according to claim 1, wherein said electrical circuit generates a high frequency charge, greater than the flicker rate of the human eye, on said conductive substrate.

19. A novelty device according to claim 1, wherein said electric circuit comprises an oscillator which generates the alternating current;

a diode rectifies said alternating current to a periodic positive peak current; and a capacitor optimizes the peak to average power ratio of the current for the novelty device.

20. A novelty device according to claim 19, wherein said electrical circuit generates a substantially sinusoidal positive peak current.

* * * * *